US008303365B2

(12) United States Patent
Lin

(10) Patent No.: US 8,303,365 B2
(45) Date of Patent: Nov. 6, 2012

(54) JET PROPULSION CONSTRUCTION TOY ASSEMBLY

(76) Inventor: Wen-Pin Lin, Taichung (TW)

( * ) Notice: Subject to any disclaimer, the term of this patent is extended or adjusted under 35 U.S.C. 154(b) by 272 days.

(21) Appl. No.: 12/730,014

(22) Filed: Mar. 23, 2010

(65) Prior Publication Data

US 2010/0248580 A1 Sep. 30, 2010

(30) Foreign Application Priority Data

Mar. 26, 2009 (TW) ..... 98109894 A

(51) Int. Cl.
*A63H 27/26* (2006.01)

(52) U.S. Cl. ..... 446/56

(58) Field of Classification Search ..... 446/211
See application file for complete search history.

(56) References Cited

U.S. PATENT DOCUMENTS 6,318,350 B1 * 11/2001 Williams ..... 124/71
6,347,623 B1 * 2/2002 Kownacki et al. ..... 124/56
7,731,064 B2 * 6/2010 Chuang et al. ..... 222/321.1
2005/0191930 A1 9/2005 Foster et al.

* cited by examiner

*Primary Examiner* — Michael Dennis
(74) *Attorney, Agent, or Firm* — Christie, Parker & Hale, LLP

(57) ABSTRACT

A jet propulsion construction toy assembly includes a container mounted on a movable brick assembly. A launching unit includes a launching seat permitting extension of a nozzle of the container thereinto and having an inlet. When the nozzle extends into the launching seat, an actuator mounted movably in said launching seat is operable to engage the nozzle such that said container is filled with fluid including air and liquid and pumped out of a barrel by a pump through first and second conduits, the inlet and the nozzle. Thereafter, when the nozzle is released from the launching seat due to disengagement between the nozzle and the actuator, jet of the fluid from the container through the nozzle forms a propulsion force to drive movement of a combination of the brick assembly and the container away from the launching unit.

6 Claims, 7 Drawing Sheets

JET PROPULSION CONSTRUCTION TOY ASSEMBLY

CROSS-REFERENCE TO RELATED APPLICATION

This application claims priority of Taiwanese Application No. 098109894, filed on Mar. 26, 2009.

BACKGROUND OF THE INVENTION

1. Field of the Invention

The invention relates to a jet propulsion toy assembly, more particularly to a jet propulsion construction toy assembly.

2. Description of the Related Art

FIG. 1 illustrates a conventional jet propulsion toy assembly 1 that includes a container 11 shaped as a rocket and mounted detachably to a launching seat 12, and an air pump 13.

In operation, first, the container 11 must be disassembled from the launching seat 12, and water is then injected into the container 11. Thereafter, the container 11 with water is mounted to the launching seat 12, and is filled with air pumped by the air pump 13 until air pressure in the container 11 reaches a threshold pressure. Therefore, when the container 11 is released from the launching seat 12, jet of water from the container 11 forms a propulsion force to drive upward movement of the container 11.

However, upon exhaustion of water in the container 11, the falling container 11 with a sharp appearance may injure players. Therefore, the conventional jet propulsion toy assembly 1 cannot ensure safety during play. Furthermore, when the container 11 with water is assembled to the launching seat 12, water leakage easily occurs, thereby resulting in inconvenience and inferior propulsion effect.

SUMMARY OF THE INVENTION

Therefore, an object of the present invention is to provide a jet propulsion construction toy assembly that can overcome the aforesaid drawbacks of the prior art.

According to the present invention, a jet propulsion construction toy assembly comprises:

a movable brick assembly;

a container mounted on the brick assembly, configured with an inner receiving space, and having an outwardly extending tubular nozzle in spatial communication with the inner receiving space;

a launching unit including a launching seat formed with an opening, permitting extension of the nozzle of the container thereinto through the opening, and having an inlet in spatial communication with the nozzle of the container when the nozzle of the container is retained in the launching seat, and an actuator mounted movably in the launching seat, and operable to move between an engaging position and a releasing position, wherein, when the nozzle of the container extends into the launching seat, the actuator engages the nozzle of the container when in the engaging position such that the nozzle of the container is retained in the launching seat, and disengages the nozzle of the container when in the releasing position such that the nozzle of the container is released from the launching seat; and a fluid supplying unit including a barrel adapted for receiving fluid that includes air and liquid, a pump, a first conduit interconnecting the barrel and the pump, and a second conduit interconnecting the pump and the inlet of the launching seat of the launching unit.

When the nozzle of the container is retained in the launching seat of the launching unit, the pump of the fluid supplying unit is operable to pump the fluid out of the barrel through the first conduit into the inner receiving space in the container through the second conduit, the inlet of the launching seat of the launching unit and the nozzle of the container such that the inner receiving space in the container is filled with the fluid pumped by the pump. Subsequently, when the actuator is moved from the engaging position to the releasing position, jet of the fluid from the inner receiving space in the container through the nozzle forms a propulsion force to drive movement of a combination of the brick assembly and the container away from the launching unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
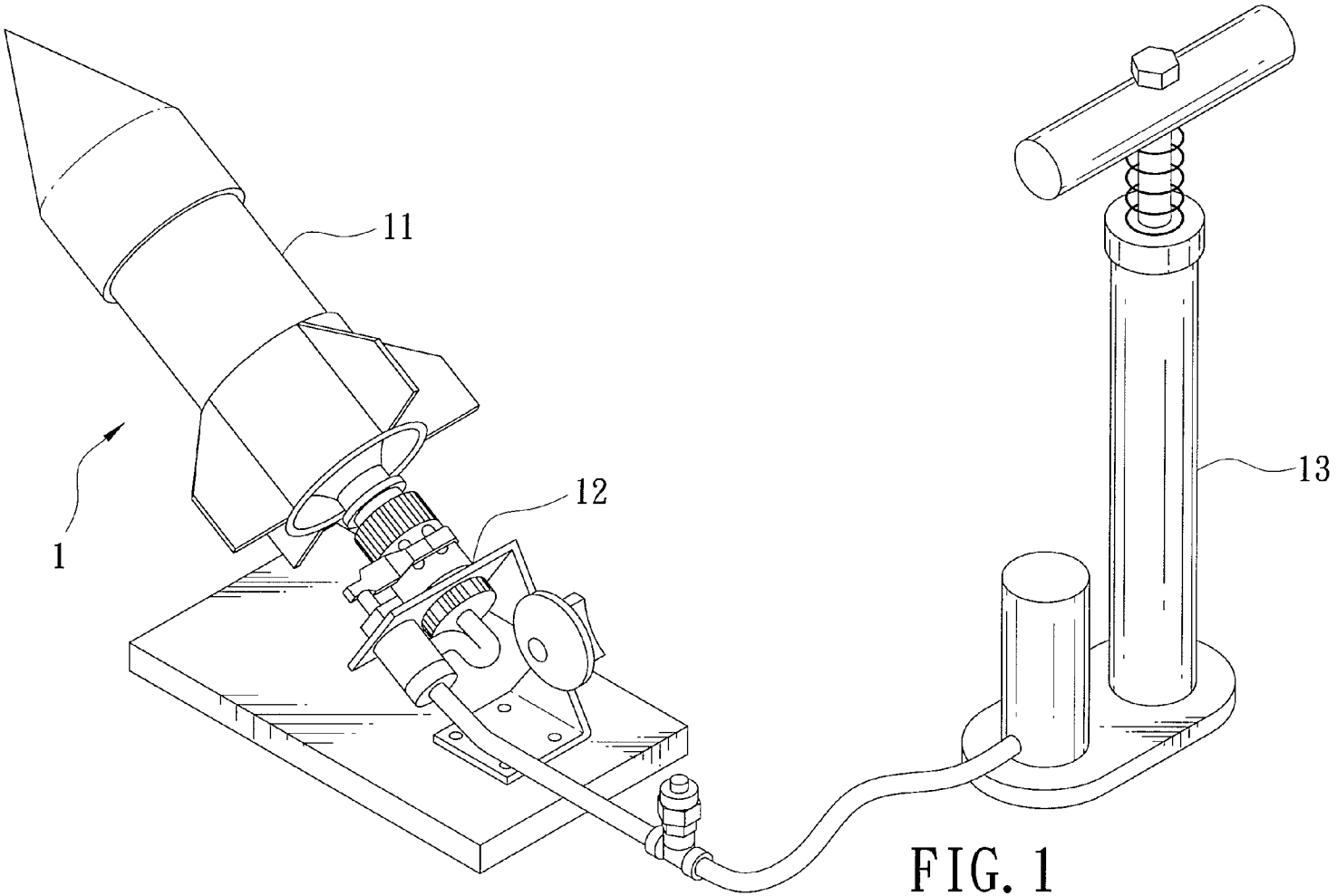
FIG. 1 PRIOR ART
FIG. 1 is a perspective view of a conventional jet propulsion toy assembly.
Figure 2:
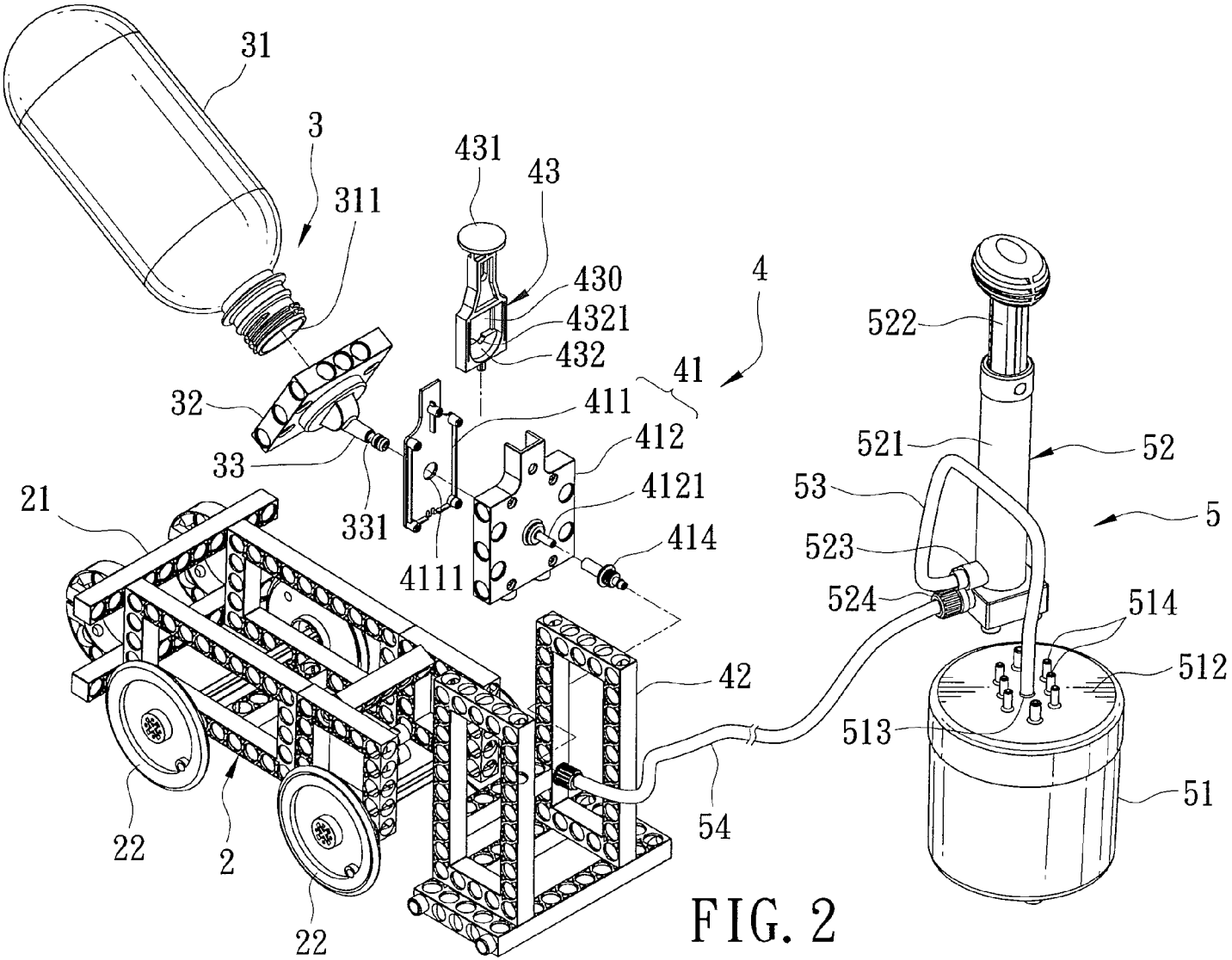
FIG. 2 is a partly exploded perspective view showing the preferred embodiment of a jet propulsion construction toy assembly according to the present invention.
Figure 3:
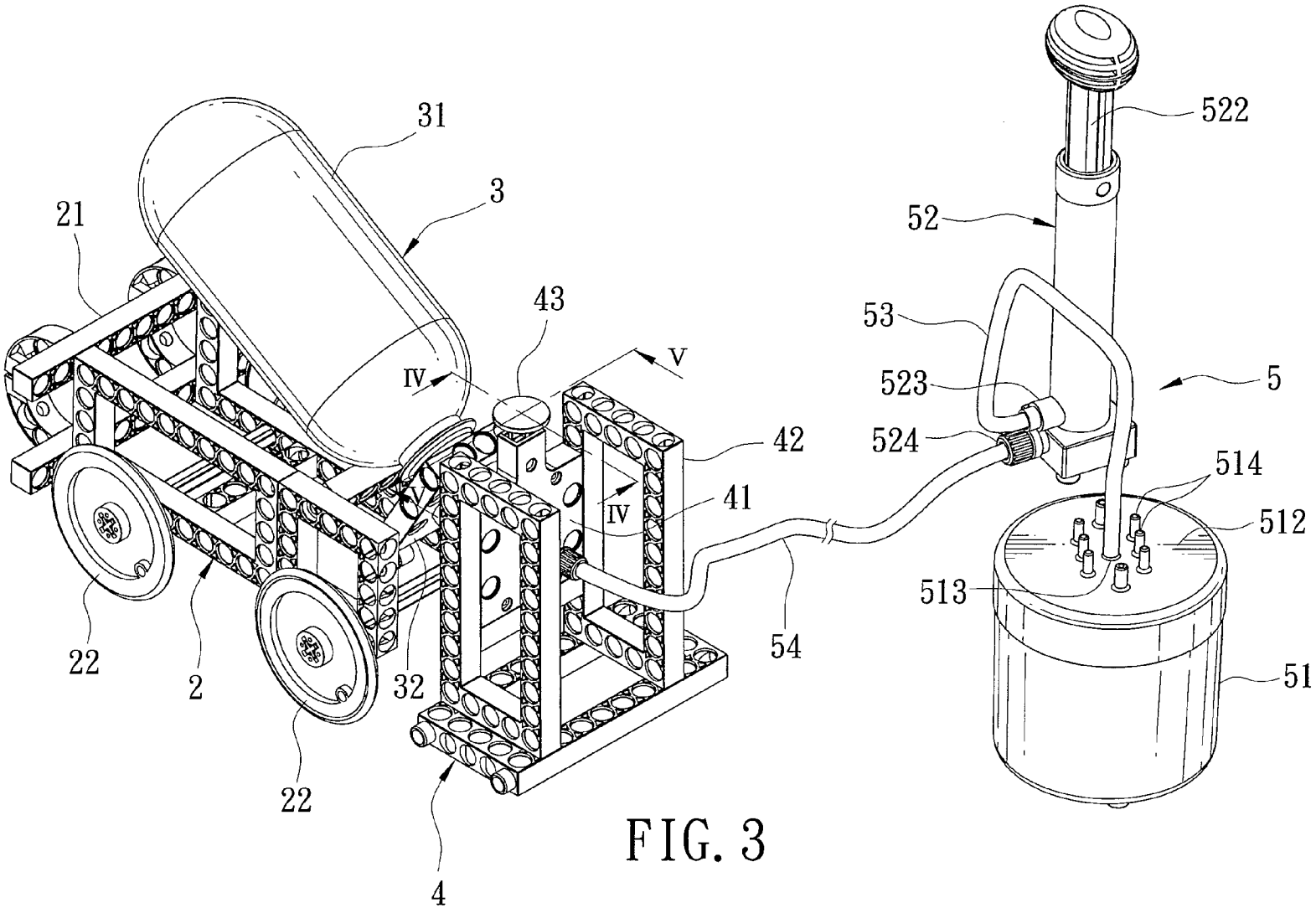
FIG. 3 is an assembled perspective view showing the preferred embodiment when an actuator is in an engaging position.
Figure 4:
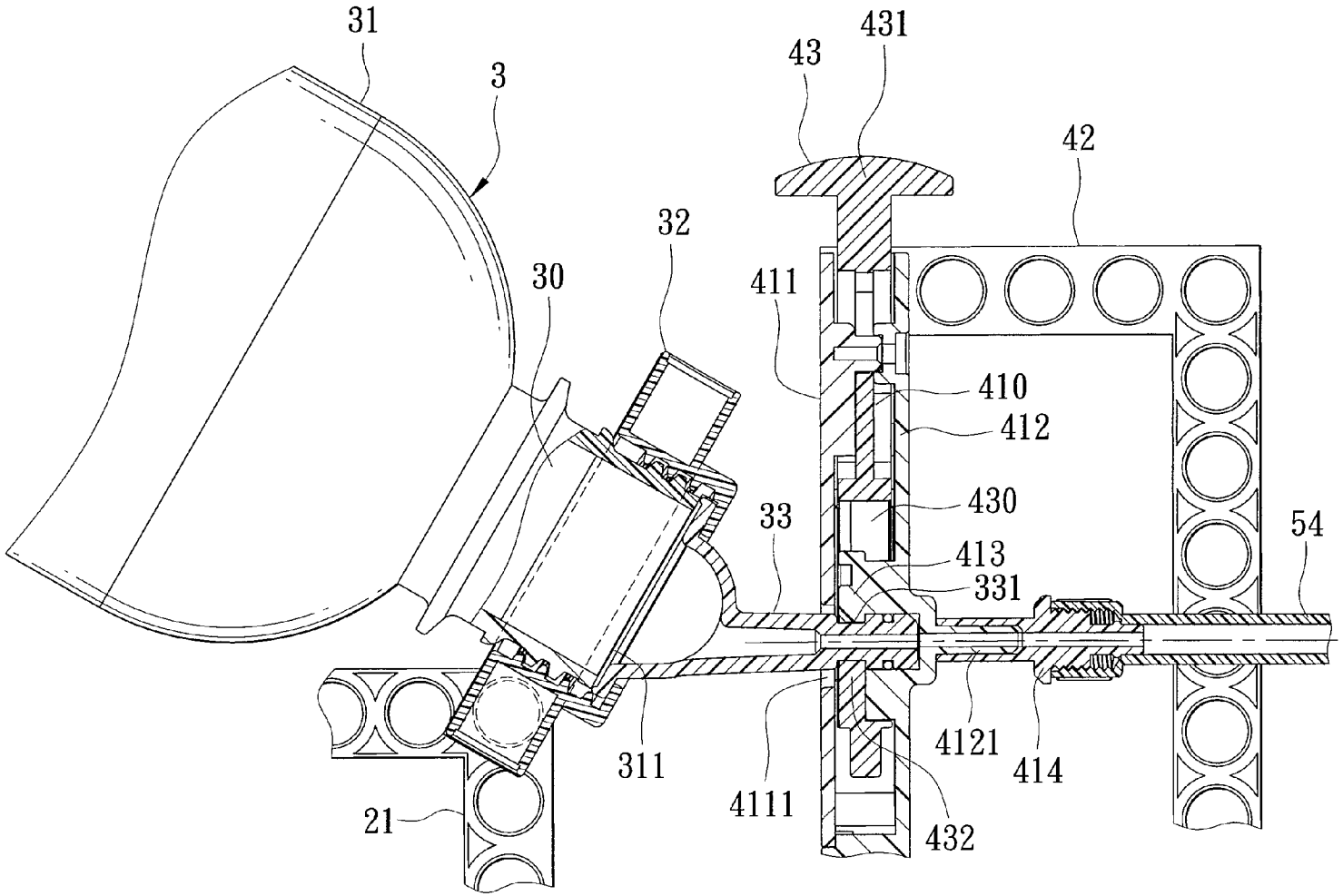
FIG. 4 is a fragmentary schematic sectional view of the preferred embodiment taken along line IV-IV in FIG. 3.

Referring to FIGS. 2 to 4, the preferred embodiment of a jet propulsion construction toy assembly according to the present invention is shown to include a movable brick assembly 2, a container 3, a launching unit 4, and a fluid supplying unit 5.

In this embodiment, the brick assembly 2 includes a plurality of bricks assembled to each other to form a main frame 21, and a plurality of rolling members 22 connected pivotally to the main frame 21, wherein the main frame 21 is shaped as a car body, and the rolling members 22 are in the form of a wheel.

The container 3 is mounted on the brick assembly 2, is configured with an inner receiving space 30 (see FIG. 4), and has an outwardly extending tubular nozzle 33 in spatial communication with the inner receiving space 30. In this embodiment, the container 3 includes a bottle body 31 having an open end 311, and a brick-like cap body 32 connected to the main frame 21 of the brick assembly 2, covering sealingly the open end 311 of the bottle body 31 and formed with the nozzle 33. The cap body 32 cooperates with the bottle body 31 to define the inner receiving space 30 therebetween. The nozzle 33 has an outer annular surface formed with an annular engaging groove 331.

The launching unit 4 includes a mounting frame 42, a launching seat 41, and an actuator 43.

In this embodiment, the main frame 42 consists of a plurality of bricks assembled to each other.

The launching seat 41 is mounted on the main frame 42, is formed with an opening 4111, permits extension of the nozzle 33 of the container 3 thereinto through the opening 4111, and has an inlet 4121 in spatial communication with the nozzle 33 of the container 3 when the nozzle 33 of the container 3 is retained in the launching seat 41 (see FIG. 4). In this embodiment, the launching seat 41 includes complementary first and second casing parts 411, 412, and is formed with an inner accommodating space 410 that is defined between the first and second casing parts 411, 412 and that is in spatial communication with the opening 4111 and the inlet 4121. The first casing part 411 is formed with the opening 4111. The second casing part 412 is formed with the inlet 4121. The launching seat 4 has a stopping block 413 fixed in the inner accommodating space 410 and formed integrally on an inner surface of the second casing part 412.

Figure 5:
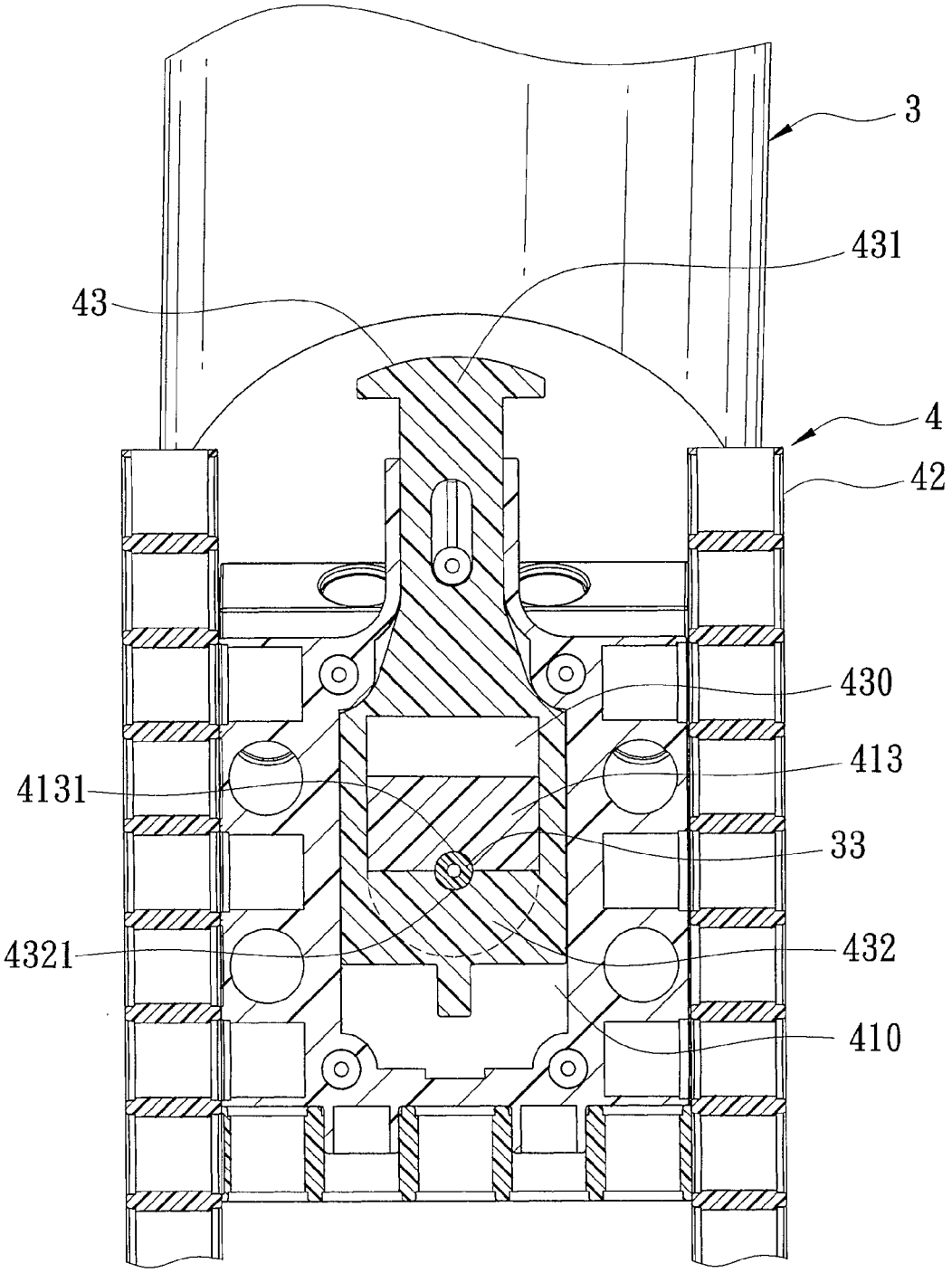
FIG. 5 is a fragmentary schematic sectional view of the preferred embodiment taken along line V-V in FIG. 3.
Figure 6:
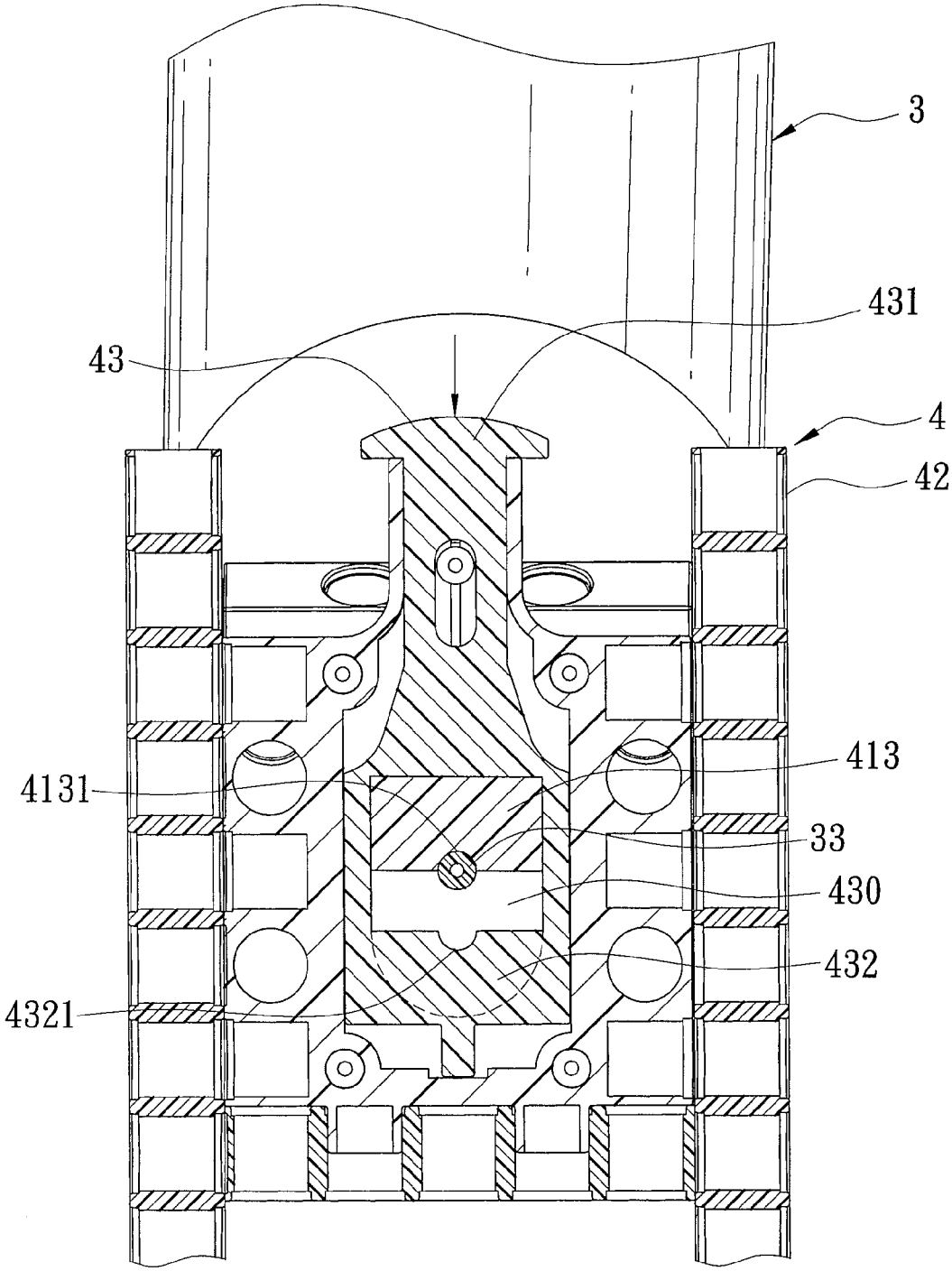
FIG. 6 is a fragmentary schematic sectional view showing the preferred embodiment when the actuator is in a releasing position.

The actuator 43 is mounted movably in the inner accommodating space 43 in the launching seat 41, and is operable to move between an engaging position and a releasing position. In this embodiment, the actuator 43 has an engaging end portion 431 extending outwardly of the launching seat 41 and in the form of a knob button, an engaging end portion 432 opposite to the operating end portion 431, and is formed with a through hole 430 disposed between the operating end portion 431 and the engaging end portion 432 and permitting extension of the stopping block 413 of the launching seat 41 and the nozzle 33 of the container 3 therethrough such that the nozzle 33 of the container 3 is disposed between the engaging end portion 432 of the actuator 43 and the stopping block 413 upon extension of the nozzle 33 of the container 3 into the inner accommodating space 410 in the launching seat 41, as shown in FIG. 4. In operation, after the nozzle 33 of the container 3 extends into the launching seat 41, when the actuator 43 is operated to move from the releasing position to the engaging position, the engaging end portion 432 of the actuator 43 moves toward the stopping block 413 such that concave edges 4131, 4321 of the stopping block 413 and the engaging end portion 432 of the actuator 43 extend into and engage the outer annular groove 331 in the nozzle 33 of the container 3, as shown in FIG. 5. As a result, the nozzle 33 of the container 3 is clamped between the engaging end portion 432 of the actuator 43 and the stopping block 413 such that the nozzle 33 is retained in the launching seat 41. On the other hand, when the actuator 43 is moved from the engaging position to the releasing position, the engaging end portion 432 of the actuator 43 moves away from the nozzle 33 of the container 3 such that the concave edge 4321 of the engaging end portion 432 of the actuator 43 disengages the outer annular groove 331 in the nozzle 33, thereby releasing the nozzle 33 of the container 3 from the launching seat 41, as shown in FIG. 6.

The fluid supply unit 5 includes a barrel 51, a pump 52, a first conduit 53, and a second conduit 54.

The barrel 51 has a top cover 51 formed with a plurality of inlets 514, and an outlet 513, and is adapted for receiving fluid that includes air and liquid, such as water, in this embodiment.

In this embodiment, the pump 52 includes a cylinder body 521 defining a fluid chamber therein (not shown), a piston rod 522 coupled movably and sealingly to the cylinder body 521, and input and output valves 523, 524 disposed on the cylinder body 521 and in spatial communication with the fluid chamber.

The first conduit 53 interconnects the outlet 513 of the barrel 51 and the input valve 523.

The second conduit 54 has one end connected to the output valve 524 of the pump 52, and the other end connected to the inlet 4121 of the launching seat 41 through a connecting tube 414, as best shown in FIG. 4.

The piston rod 522 of the pump 52 is operable to draw the fluid from the barrel 51 into the fluid chamber through the outlet 513 of the barrel 51, the first conduit 53 and the input valve 523 and to pump the fluid in the fluid chamber in the cylinder body 521 into the second conduit 54 through the output valve 524.

Figure 7:
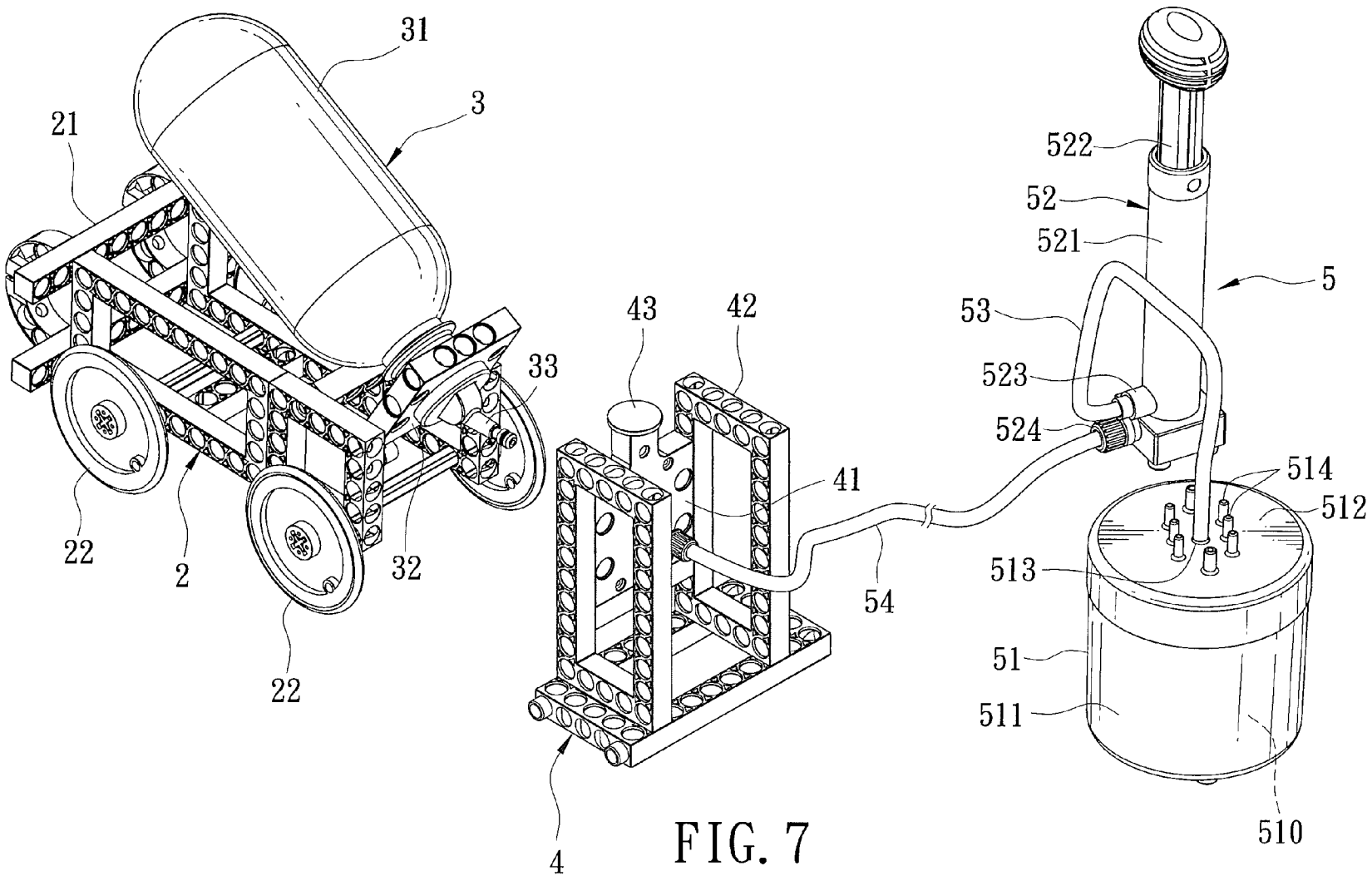
FIG. 7 is a perspective view showing the preferred embodiment when a combination of a container and a brick assembly is moved away from a launching unit.

When playing, after the nozzle 33 of the container 3 is retained in the launching seat 41 of the launching unit 4, the pump 52 of the fluid supplying unit 5 is operable to pump the fluid out of the barrel 51 through the first conduit 53 into the inner receiving space 30 in the container 3 through the second conduit 53, the connecting tube 414, the inlet 4121 of the launching seat 41 of the launching unit 4 and the nozzle 33 of the container 3 such that the inner receiving space 30 in the container 3 is filled with the fluid pumped by the pump 52. It is noted that, water of the fluid received in the barrel 51 is first pumped into the inner receiving space 30 in the container 3, and then air of the fluid is pumped out of the barrel 51 into the inner receiving space 30 in the container 3 to increase air pressure in the inner receiving space 30 until the air pressure in the inner receiving space 30 in the container 3 reaches a threshold pressure. Subsequently, when the actuator 43 is moved from the engaging position to the releasing position through operation of the operating end portion 431 of the actuator 43, jet of water from the inner receiving space 30 in the container 3 through the nozzle 33 forms a propulsion force to drive movement of a combination of the brick assembly 2 and the container 3 away from the launching unit 4, as shown in FIG. 7.

The following are some of the advantages attributed to the jet propulsion construction toy assembly of the present invention:

1. Since the brick assembly 2 can be constructed to have various structures, the jet propulsion construction toy assembly of the present invention has enhanced variety and creativity.

2. When playing with the jet propulsion construction toy assembly, a supporting surface for movement of the combination of the brick assembly 2 and the container 3 is required. Therefore, for small children, the jet propulsion construction toy assembly of the present invention can be safely played with at home.

3. In operation, after the nozzle 33 of the container 3 is retained in the launching seat 41, by operation of the pump 52, the inner receiving space 310 in the container 3 can be filled with water and air continuously, thereby resulting in convenience as compared to the aforesaid conventional jet propulsion toy assembly.

4. When the first and second conduits 53, 54 are transparent pipes and the liquid is colored, players can see flow of the fluid into the container 3, thereby increasing fun and realizing loop design related to the fluid supplying unit 5.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A jet propulsion construction toy assembly comprising:

a movable brick assembly;

a container mounted on said brick assembly, configured with an inner receiving space, and having an outwardly extending tubular nozzle in spatial communication with said inner receiving space;

a launching unit including a launching seat formed with an opening, permitting extension of said nozzle of said container thereinto through said opening, and having an inlet in spatial communication with said nozzle of said container when said nozzle of said container is retained in said launching seat, and an actuator mounted movably in said launching seat, and directly operable to move between an engaging position and a releasing position along an axis, wherein, when said nozzle of said container extends into said launching seat, said actuator engages said nozzle of said container when in the engaging position such that said nozzle of said container is retained in said launching seat, and disengages said nozzle of said container when in the releasing position such that said nozzle of said container is released from said launching seat; and a fluid supplying unit including a barrel adapted for receiving fluid that includes air and liquid, a pump, a first conduit interconnecting said barrel and said pump, and a second conduit interconnecting said pump and said inlet of said launching seat of said launching unit;

wherein, when said nozzle of said container is retained in said launching seat of said launching unit, said pump of said fluid supplying unit is operable to pump the fluid out of said barrel through said first conduit into said inner receiving space in said container through said second conduit, said inlet of said launching seat of said launching unit and said nozzle of said container such that said inner receiving space in said container is filled with the fluid pumped by said pump, and subsequently, when said actuator is moved from the engaging position to the releasing position, jet of the fluid from the inner receiving space in said container through said nozzle forms a propulsion force to drive movement of a combination of said brick assembly and said container away from said launching unit;

wherein said nozzle of said container has an outer annular surface formed with an annular engaging groove;

wherein said launching seat of said launching unit is formed with an inner accommodating space therein in spatial communication with said opening and said inlet, and has a stopping block fixed in said inner accommodating space;

wherein said actuator of said launching unit is disposed movably in said inner accommodating space in said launching seat, has an accessible operating end portion extending outwardly of said launching seat, and an engaging end portion opposite to said operating end portion along the axis, and is formed with a through hole disposed between said operating end portion and said engaging end portion and permitting extension of said stopping block of said launching seat and said nozzle of said container therethrough such that said nozzle of said container is disposed between said engaging end portion of said actuator and said stopping block upon extension of said nozzle of said container into said inner accommodating space in said launching seat; and wherein, when said nozzle of said container extends into said inner accommodating space in said launching seat while said operating end portion of said actuator is directly operated to move said actuator along the axis from the releasing position to the engaging position, said engaging end portion of said actuator moves toward said stopping block such that said stopping block and said engaging end portion of said actuator engage said outer annular surface in said nozzle of said container, thereby clamping said nozzle of said container between said engaging end portion of said actuator and said stopping block.

2. The jet propulsion construction toy assembly as claimed in claim 1, wherein said brick assembly includes a plurality of bricks assembled to each other to form a main frame, and a plurality of rolling members connected pivotally to said main frame.

3. The jet propulsion construction toy assembly as claimed in claim 1, wherein said container includes:

a bottle body having an open end; and a brick-like cap body connected to said brick assembly, covering sealingly said open end of said bottle body and formed with said nozzle, said cap body cooperating with said bottle body to define said inner receiving space therebetween.

4. The jet propulsion construction toy assembly as claimed in claim 1, wherein said launching seat includes complementary first and second casing parts defining said inner accommodating space therebetween, said first casing part being formed with said opening, said second casing part being formed with said inlet, and having an inner surface provided with said stopping block thereon.

5. The jet propulsion construction toy assembly as claimed in claim 1, wherein said barrel has a top cover formed with at least one inlet, and at least one outlet connected to said first conduit.

6. The jet propulsion construction toy assembly as claimed in claim 1, wherein said pump includes a cylinder body defining a fluid chamber therein, a piston rod coupled movably and sealingly to said cylinder body, and input and output valves disposed on said cylinder body, connected respectively to said first and second conduits, and in spatial communication with said fluid chamber, said piston rod being operable to draw the fluid from said barrel into said fluid chamber through said first conduit and said input valve and to pump the fluid in said fluid chamber in said cylinder body into said second conduit through said output valve.

* * * * *